US008440072B2

(12) United States Patent
Subramaniyam

(10) Patent No.: US 8,440,072 B2
(45) Date of Patent: May 14, 2013

(54) METHOD OF REMOVING METALS FROM HYDROCARBON FEEDSTOCK USING ESTERS OF CARBOXYLIC ACIDS

(75) Inventor: Mahesh Subramaniyam, Maharashtra (IN)

(73) Assignee: Dorf Ketal Chemicals (I) Private Limited, Mumbai (IN)

( * ) Notice: Subject to any disclaimer, the term of this patent is extended or adjusted under 35 U.S.C. 154(b) by 855 days.

(21) Appl. No.: 12/509,073

(22) Filed: Jul. 24, 2009

(65) Prior Publication Data

US 2009/0283449 A1 Nov. 19, 2009

Related U.S. Application Data

(63) Continuation of application No. PCT/IN2009/000062, filed on Jan. 23, 2009.

(30) Foreign Application Priority Data

Jan. 24, 2008 (IN) ..... 166/MUM/2008

(51) Int. Cl.
*C10G 17/02* (2006.01)

(52) U.S. Cl.
USPC ..... 208/251 R; 208/45; 208/87; 208/90; 208/252; 208/311; 560/1; 560/8; 560/204

(58) Field of Classification Search ..... 208/45, 208/87, 90, 252, 311, 251 R; 506/1, 8, 190–204
See application file for complete search history.

(56) References Cited

U.S. PATENT DOCUMENTS 4,629,807 A * 12/1986 Knifton ..... 560/204
4,853,109 A 8/1989 Reynolds
5,078,858 A 1/1992 Hart et al.
5,080,779 A 1/1992 Awbrey et al.

(Continued)

FOREIGN PATENT DOCUMENTS

WO 2005085392 A1 9/2005
WO 2007086661 A1 8/2007

(Continued)

OTHER PUBLICATIONS

Foreign communication from a related counterpart application—International Search Report, PCT/IN2009/000062, Oct. 5, 2009, 4 pages.

*Primary Examiner* — Brian McCaig
(74) *Attorney, Agent, or Firm* — Conley Rose, P.C.; Rodney B. Carroll

(57) ABSTRACT

Method of removing metals from hydrocarbon feedstock using esters of carboxylic acids, and additives for the same, are provided, wherein hydrocarbon stream including crude oil containing metals and salts thereof, wherein metal is calcium and its salt is calcium naphthenate, is mixed with an effective metal-removing-amount of an aqueous extraction-solution of non-precipitating and non-fouling additive comprising a chemical compound selected from a group consisting of methyl or ethyl or propyl or isopropyl mono- and/or di-esters of any one of the carboxylic acids selected from the groups consisting of maleic acid, maleic anhydride, and fumaric acid, or an appropriate combination of said esters, or an appropriate combination of any of said esters with any of said carboxylic acids to form a hydrocarbonous phase and an aqueous phase containing the metal ions; and separating aqueous phase.

18 Claims, 10 Drawing Sheets

U.S. PATENT DOCUMENTS

| | | | | |
|---|---|---|---|---|
| 6,274,542 | B1 * | 8/2001 | Carr et al. | 510/376 |
| 6,713,649 | B1 | 3/2004 | Hladiy et al. | |
| 7,399,403 | B2 | 7/2008 | Garcia, III et al. | |
| 2004/0199026 | A1 * | 10/2004 | Sutton et al. | 568/671 |
| 2005/0241997 | A1 | 11/2005 | Kremer et al. | |

FOREIGN PATENT DOCUMENTS

| | | | |
|---|---|---|---|
| WO | 2008007847 | A1 | 1/2008 |
| WO | 2008062433 | A2 | 5/2008 |
| WO | 2009113095 | A2 | 9/2009 |
| WO | 2009113095 | A3 | 9/2009 |

* cited by examiner

METHOD OF REMOVING METALS FROM HYDROCARBON FEEDSTOCK USING ESTERS OF CARBOXYLIC ACIDS

CROSS-REFERENCE TO RELATED APPLICATIONS

This application is a continuation application of International Application No. PCT/IN2009/000062 filed Jan. 23, 2009, entitled "Method of Removing Metals from Hydrocarbon Feedstock Using Esters of Carboxylic Acids," claiming priority of Indian Patent Application No. 166/MUM/2008 filed Jan. 24, 2008, which applications are incorporated by reference herein in their entirety.

FIELD OF INVENTION

The present invention is generally related to the field of hydrocarbon industry and particularly related to removal of metals from hydrocarbon feedstock and more particularly to removal of calcium from the same.

BACKGROUND OF INVENTION

Considering the rising prices of crude oil, the refiners are forced to process opportunity crude such as DOBA, to be competitive. However these opportunity crudes pose many problems such as fouling of heat exchangers, difficulties in effluent treatment, poisoning of catalyst by certain metallic salts and such other problems.

Among the metals, calcium poses very serious problems which cannot be tackled using the current refinery processes. Calcium exists in crude oil as calcium complex of naphthenic acid, which hereinafter is referred to as calcium naphthenate. The calcium naphthenate is not removed from the crude oil during the normal desalting process. The examples of the type of crude oil which contains large amounts of calcium naphthenate are crudes from China such as Shengli No. 2; DOBA from West Africa; Gryphon and Harding crude oil from the North Sea; and SJV from the West Coast of USA.

In an oil refinery, the desalting of crude oil has been practiced for many years. The crude is usually contaminated from several sources, including, metals including calcium, zinc, silicon, nickel, sodium, potassium, and such other metals.

Desalting is necessary prior to further processing to remove these compounds and other inorganic materials that would otherwise cause fouling and deposits in downstream heat exchanger equipment and/or form corrosive salts detrimental to crude oil processing equipment. Further, these metals can act as poisons for the catalysts used in downstream refinery units. Effective crude oil desalting can help minimize the effects of these contaminants on the crude unit and downstream operations. Proper desalter operations provide the following benefits to the refiner:

(a) Reduced crude unit corrosion.
(b) Reduced crude preheat system fouling.
(c) Reduced potential for distillation column damage.
(d) Reduced energy costs.
(e) Reduced downstream process and product contamination.

Desalting is the resolution of the natural emulsion of water that accompanies the crude oil by creating another emulsion in which about 5 percent relative wash water is dispersed into the oil using a mix valve. The emulsion mix is directed into a desalter vessel containing a parallel series of electrically charged plates. Under this arrangement, the oil and water emulsion is exposed to the applied electrical field. An induced dipole is formed on each water droplet within the emulsion that causes electrostatic attraction and coalescence of the water droplets into larger and larger droplets. Eventually, the emulsion resolves into two separate phases—the oil phase (top layer) and the water phase (bottom layer). The streams of desalted crude oil and effluent water are separately discharged from the desalter.

The entire desalting process is a continuous flow procedure as opposed to a batch process. Normally, chemical additives are injected before the mix valve to help resolve the oil/water emulsion in addition to the use of electrostatic coalescence. These additives effectively allow small water droplets to more easily coalesce by lowering the oil/water interfacial tension.

Crude oil that contains a high percent of particulate solids can complicate the desalting process. The particulate solids, by nature, would prefer to transfer to the water phase. However, much of the solids in a crude oil from a field exist in tight water-in-oil emulsions. That is, oil-wetted solids in high concentration in the crude may help form tight oil and water emulsions that are difficult to resolve. These tight emulsions are often referred to as "rag" and may exist as a layer between the separated oil and water phases. The rag layer inside the desalter vessel may grow to such an extent that some of it will be inadvertently discharged with the water phase. This is a problem for the waste water treatment plant since the rag layer still contains a high percentage of unresolved emulsified oil.

Much of the solids encountered during crude oil desalting consists commonly as particulates such as iron oxide, iron sulfide, sand, clay and even phosphorus-containing compounds, etc. Other metals that are desirably removed include, but are not necessarily limited to, calcium, zinc, silicon, nickel, sodium, potassium, and the like, and typically a number of these metals are present. Some of the materials may be present in a soluble form, and some may require modification through reaction such as reaction or neutralization to become soluble. The metals may be present in inorganic or organic forms. In addition to complicating the desalter operation, phosphorus and other contaminants are of particular concern to further downstream processing. This includes the coking operation since iron and other metals remaining in the processed hydrocarbon yields a lower grade of coke. Removing the metals from the crude oil early in the hydrocarbon processing stages is desired to eventually yield high quality coke as well as to limit corrosion and fouling processing problems.

Several treatment approaches have been made to reduce total contaminant levels and these all center on the removal of contaminants at the desalter unit. Normally, the desalter only removes water soluble inorganic salts such as sodium or potassium chlorides.

Basic metals such as calcium, when present in crude oil can lead to fouling of heaters and heat exchangers and poison catalysts used in crude processing. When present as inorganic salts, such as, chlorides, usually in oil-encapsulated water phase, the salts can hydrolyze to release corrosive mineral acids. Refinery desalters customarily remove such salts. However, oil-soluble metal salts such as naphthenates and phenolates are not removed by conventional desalting. Therefore, oil-soluble, basic metal-rich crudes are less valuable than crudes with low levels of such metals. A process for metal ion removal enables the increase of the value of such crudes.

A few, but increasingly important, petroleum crude feedstocks, residua, and deasphalted oil derived from them, contain levels of calcium or iron which render them difficult, if not impossible, to process using conventional refining techniques. The metals contaminants causing particular problems are in the form of nonporphyrin, organometallically bound compounds. These species have been attributed to either naturally occurring calcium complexes or solubilized calcium from recovery waters that comes in contact with crude oils. One possible class of calcium compounds identified in particular is the respective naphthenates and their homologous series. These organometallic compounds are not separated from the feedstock by normal desalting processes, and in a conventional refining technique they can cause the very rapid deactivation of hydroprocessing catalysts. Examples of feedstocks demonstrating objectionably high levels of calcium compounds are crudes from China such as Shengli No. 2; DOBA from West Africa; Gryphon and Harding crude oil from the North Sea; and SJV from the West Coast of USA.

US Patent Application 20050241996 describes the use of only poly (acrylic acid) derivatives, (that is, polymers) for removing metal irons from hydrocarbon feedstocks. Even though this patent has listed 16 representative non-ionic water soluble monomers, 27 representative anionic monomers and 30 cationic monomers, wherein list of anionic monomers include maleic acid and fumaric acid, there is absolutely no suggestion or teaching in this patent, that any of these monomers can be used independently or in combination for removing metal ions from the hydrocarbon feedstocks. There is insistence in this patent on use of aqueous solution of only one or more water-soluble poly (acrylic acid) derivatives, that is use of polymers for the purpose of this US Patent Application.

It is known to a person skilled in the art that, it is necessary that a catalyst is used to react with a monomer of an acid to form its derivatives in a polymeric form. This adds to the cost of the process due to time involved and equipments and chemicals used in the process and such other factors.

In addition, it is observed by the inventor of present invention that when poly (acrylic acid) derivative of US Patent Application 20050241996 is used, (that is, ACUMER-1000 is used), heavy precipitation takes place, which can lead to fouling of the processing equipments. This is clear from the data provided in Table 6, Experiment No. 1 of the present specification. Also to prevent this precipitation higher dosages of the additive are required. The higher dosage will lead to higher cost. Other disadvantage of using additives having a tendency to precipitate is that it will be difficult to control the dosage at the desired level in the equipments in the field, such as crude desalter, and hence additive will have to be used always in excess.

US Patent Application 2005/0241997 A1 describes different additives useful for enhancing phosphorous compound removal in refinery desalting process. Reactive phosphorus species can be removed or transferred from a hydrocarbon phase to a water phase in an emulsion breaking process by using a composition that contains water-soluble hydroxy acids. Suitable water-soluble hydroxy acids include, but are not necessarily limited to glycolic acid, gluconic acid, $C_2$-$C_4$ alpha-hydroxy acids, poly hydroxy carboxylic acids, thioglycolic acid, chloro acetic acid, polymeric forms of the above hydroxyacids, poly-glycolic esters, glycolate ethers, and ammonium salt and alkali metal salts of these hydroxyacids, and mixtures thereof. The composition may optionally include a mineral acid to reduce the pH of the desalter wash water. A solvent may be optionally included in the composition. This US Patent Application permits transfer of reactive phosphorus species into the aqueous phase with little or no hydrocarbon phase undercarry into the aqueous phase. The composition is particularly useful in treating crude oil emulsions, and in removing calcium and other metals therefrom.

This US Patent Application 2005/0241997 A1, teaches the use of only hydroxyl mono-carboxylic acids such as, glycolic acid and polyhydroxy derivative thereof, like gluconic acid as an additive compound for removal of reactive phosphorous species, and calcium and other metals, from the hydrocarbon feedstock. However, the disadvantage of the use of these acids and derivatives as additives compound, as seen from the experiments conducted by the present inventor to remove calcium from calcium napthenate from hydrocarbon feedstock, is that these acids require higher dosages as additive compound since they are to be used in 2:1 molar ratio with respect to calcium. When gluconic acid was used as additive compound by the present inventor, in the same molar ratio, that is, 2:1, very high dosage of gluconic acid is required.

The inventor of the present invention, after extensive experimentation, has surprisingly found that the use of any of the esters of various dicarboxylic acids such as monomethyl maleate, monomethyl oxylate, dimethyl maleate and ester of tricarboxylic acids such as citric acid and also esters of polycarboxylic acids is very effective in removal of metals like calcium and iron from hydrocarbon feedstock. The prior art has never mentioned use of above mentioned esters for this purpose. It is surprisingly found by the present inventor that among all the esters of carboxylic acids, only a few do not lead to precipitation of calcium salt. For example, ester of maleic acid does not lead to any precipitation.

Thus it will be seen that the prior art mentions that the use of carboxylic acids is effective in removal of calcium from the hydrocarbon feedstock. However, the inventor of the present invention has surprisingly found that the use of esters of carboxylic acids is very effective in removal of calcium from the hydrocarbon feed stock.

In view of above, there is a need for developing a new method for the effective removal of metal contaminants, particularly calcium, from hydrocarbon feedstocks, including crude oil.

OBJECTS AND ADVANTAGES OF INVENTION

Accordingly, different objects and advantages of the present invention are described below.

An object of the present invention is to provide an economical method with increased efficiency due to lesser dosage of the chemical compounds used, and to provide novel invention-additives to be used for calcium removal.

Another object of the present invention is to provide an efficient method to prevent precipitation of calcium salt in hydrocarbon phase or water phase, in use of some esters of carboxylic acids, and to provide novel invention-additives for calcium removal, and which are non-fouling and non-corrosive.

Still further objects and advantages of the present invention will become apparent from the ensuing detailed description of the invention.

SUMMARY OF INVENTION

Method of removing metals from hydrocarbon feedstock using esters of carboxylic acids, and additives for the same, are provided, wherein hydrocarbon stream such as crude oil containing metals and salts thereof, such as calcium and calcium naphthenate, is mixed with an effective metal-removing-amount of an aqueous extraction-solution of non-precipitating and non-fouling additive comprising a chemical compound selected from a group consisting of methyl or ethyl or propyl or isopropyl mono- and/or di-esters of any of three carboxylic acids, such as, maleic acid, maleic anhydride, or fumaric acid or an appropriate combination of said esters, or an appropriate combination of any of said esters with any of said three acids, enabling formation of a hydrocarbonous phase and an aqueous phase containing the metal ions; and separating aqueous phase.

BRIEF DESCRIPTION OF DRAWINGS

A brief description of the accompanying drawings is given below.

DETAILED DESCRIPTION OF INVENTION

Figure 1:
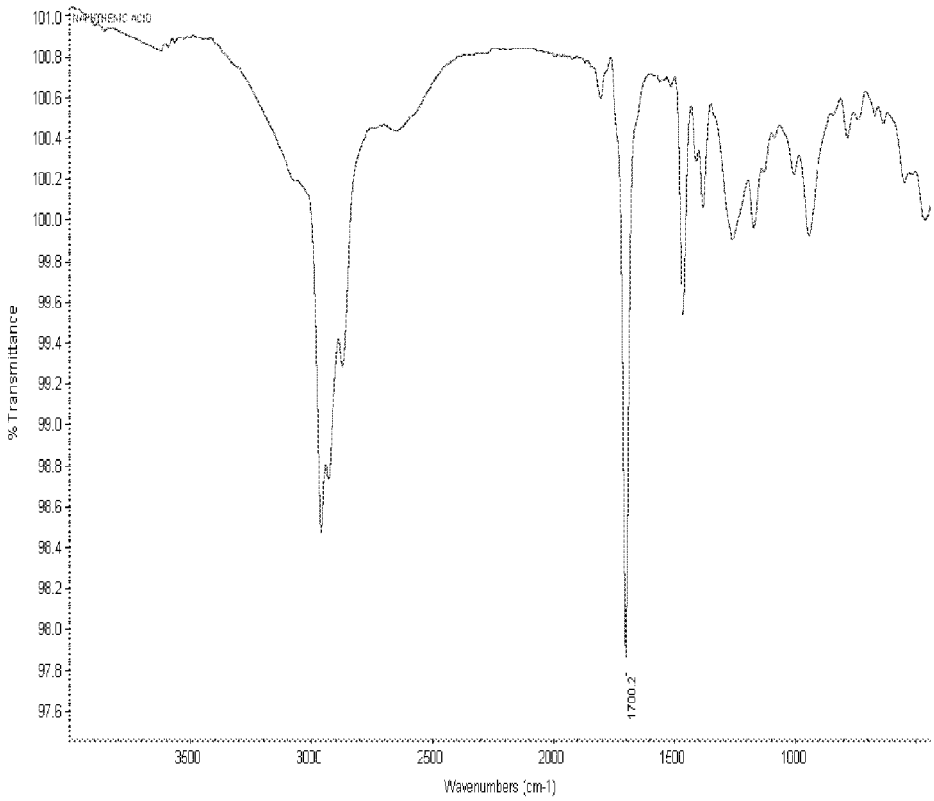
FIG. 1 shows, typical FTIR spectrum of naphthenic acid.

In the method of the present invention, for removal of calcium from the hydrocarbon feedstock, the additives comprising an effective metal-removing-amount of an aqueous extraction-solution of non-precipitating and non-fouling additive comprising a chemical compound selected from a group consisting of methyl or ethyl or propyl or isopropyl mono- and/or di-esters of any of three acids, such as, maleic acid, maleic anhydride, or fumaric acid or an appropriate combination of said esters, an appropriate combination of any of said esters with any of said three acids, enabling formation of a hydrocarbonous phase and an aqueous phase containing the metal ions, are used. According to the present invention, these esters are used to effectively remove calcium from the hydrocarbon phase, particularly from the calcium napthenate present in the hydrocarbon.

According to the most preferred embodiment of the present invention, the method of removal of calcium from the hydrocarbon feedstock, comprises the steps of:

(a) mixing the additive of the present invention, which is any one of the chemical compounds such as esters mentioned above and appropriate mixtures thereof in neat form or aqueous form or in solution with hydrocarbon, with any hydrocarbon feedstock stream such as crude oil, containing metal and its salts, such as calcium naphthenate, in a crude desalter;

(b) permitting chemical reaction between the above mentioned additive and hydrocarbon feedstock;

(c) permitting formation of two phases, that is, aqueous phase and the hydrocarbon phase;

(d) separating the two phases of step (c) or permitting them to separate.

Examples are included only to illustrate application of this embodiment of present invention and not to limit the scope of the invention.

According to another embodiment of the present invention, the method of removal of calcium from hydrocarbon feedstock comprises the steps of:

(a) mixing the additive of the present invention, which is any one of the chemical compounds such as esters mentioned above or appropriate mixtures thereof in neat form or aqueous form or in solution with hydrocarbon, with any hydrocarbon feedstock stream such as crude oil, containing metal and its salts, such as calcium naphthenate, in a crude desalter;

(b) permitting chemical reaction between the above mentioned additive and hydrocarbon feedstock;

(c) feeding the reacted mixture to the crude desalter;

(d) permitting formation of two phases, that is, aqueous phase and the hydrocarbonous phase, in the crude desalter;

(e) separating the two phases of step (d) or permitting them to separate.

These two, phases, that is, the aqueous phase and the crude or hydrocarboneous phase, are separated or permitted to separate. As a result, the aqueous solution containing the metal contaminant is removed, thereby resulting in a hydrocarbon feed with metals already removed from it, which then can be handled in the same manner as any other carboneous feed and processed by conventional hydroprocessing techniques.

It is contemplated in the most preferred embodiment that the physical separation process is ordinarily to be done in a conventional crude desalter, which is usually used for desalting petroleum crudes before they are hydroprocessed. This separation is to be done by any separation process, however, and also includes countercurrent extraction.

The contact time between the aqueous extraction solution and the hydrocarboneous feed during mixing action is important and varies from between less than few seconds to about six hours. The preferred contact time is from about 5 seconds to about 2 hours.

The calcium extraction process can be carried out at any temperature between room temperature that is about 27° C. and 160° C., more preferably between 100° C. to 140° C. or at operating temperature of any desalter. Preferably, the chemical compounds mentioned in step (a) above, are injected into the desalter wash water prior to blending of this wash water with the incoming crude oil. This mixture is then passed through a high shear valve to obtain through contact of the water with the crude oil. This process is called "desalting" and is literally removing water soluble chloride salts from the oil. The chloride salts are present due to the water found in the incoming crude oil. Essentially, the salt concentration is diluted by the addition of the wash water. The wash water is treated with dimulsifiers to help the oil/water separation. Any water remaining with oil effluent from the desalter will have low salt values. Temperatures in the desalter typically range from about 93° C. to about 163° C.

To remove metals such as calcium in the desalter, the chemical compounds mentioned in step (a) above are added continuously to the wash water. With the vigorous mixing of the oil and water, the acids formed after hydrolysis of the chemical compound, chelate the calcium. This complex formed with the calcium is water soluble; hence the calcium is removed via the water phase.

The dosage of each of the above mentioned chemical compounds and the combinations thereof, generally ranges from about 0.001 to 5 weight percent in the desalter wash water. The present invention can be used in molar, submolar or excess molar concentrations with respect to metals in the hydrocarbon stream such as calcium or its salts such as calcium napthenate.

The advantages of the use of the additives of the present invention in calcium removal are explained below in details.

The additive of the present invention in its original form as ester is in liquid form, whereas the respective acids from which corresponding esters are made are in solid form. Generally, the acids do not have high solubility in water. Whenever a solution of an acid in water is made, it has high pour point as it freezes in cold conditions. In its frozen form, pumping is not feasible, which poses serious handling difficulties. Many times, heating facilities are not available in storage area. In addition, heating is not a preferable option for maleic acid, as it is known that when maleic acid aqueous solution is exposed to temperature above 45° C., it will get converted into fumaric acid, which has extremely low solubility in water. It is also difficult to maintain temperature at 45° C. or below in storage area, because generally steam is used as a heating source, which will have temperature above 100° C. Due to its low solubility, the fumaric acid gets precipitated and clogs the pipe lines.

The ester additives of present invention do not freeze upto −27° C. temperature. Hence it can then be used in cold conditions without resorting to heating.

The Calcium-removal-effects of the ester additives of present invention are comparable to results obtained by using corresponding acids for removal of calcium.

The ester additives of present invention are soluble in hydrocarbon feedstock stream, whereas corresponding acids are insoluble in hydrocarbon feedstock streams. Hence the additives of present invention can be used in solution with hydrocarbon instead of using them in aqueous solution. This solution with hydrocarbon can be fed to the hydrocarbon feedstock stream in the crude desalter.

As the ester additives of the present invention are soluble in hydrocarbon, the additives can be added to hydrocarbon feedstock in storage area, giving the advantage of more contact time of additive with the hydrocarbon.

If the ester additive of the present invention is added to hydrocarbon feedstock which is in stored condition, which is then supplied to crude desalter, the pH of the system in crude desalter will not dip, thereby preventing acidic condition and hence preventing corrosion of equipments.

The ester additive of the present invention, being in liquid form, can be used without any solvent, that is, it can be used neat, thereby effecting savings in cost of transportation.

The foregoing may be better understood by reference to the following examples, which are presented for the purposes of illustration only and are not intended to limit the scope of the invention.

EXAMPLES

General Points about the Examples

1. The details of the quantities of Calcium-naphthenate in toluene having an amount of calcium of about 2247 ppm in the hydrocarbon layer and demineralised water, used in each of the experiments given below, are given in Table-1.
2. The Calcium naphthenate was prepared by reaction of sodium salt of naphthenic acid (2 moles) and calcium chloride (1 mole). The product was washed to remove sodium chloride. The naphthenic acid used had an acid value of approximately 226 mg KOH/gm. The resulting calcium naphthenate had approximately 7.5% of calcium. This was dissolved in toluene to get an approximately 2247 ppm of calcium. The FTIR spectra's of Naphthenic Acid and Calcium Naphthenate are shown in the FIGS. 1 and 3 respectively.
3. FTIR spectrum figures are given only for Example 1. For other examples, only the observational results are specified in Table 2.
4. The mole ratio of calcium to additive compound is also given in Table 10 to 14. Actual weight of additive compound is also mentioned in Table 10 to 14.
5. Generally, results given in Tables 10 to 14 for each additive compound represents average of three experiments.
6. Results presented in Tables 10 to 14 are obtained for extraction times and temperatures, mentioned therein.
7. Generally the Calcium content in aqueous phase was measured using Ion Chromatographic technique (IC). And for the hydrocarbon phase acid values is determined by titrating against 0.1 N normal methanolic KOH solution.
8. Generally in all examples given below, the mole ration of Ca-naphthenate to additive is 1:1 and the calcium content of Ca-naphthenate solution in toluene used for these examples is about 2247 ppm.
9. Details of calcium naphthenate solution in toluene and aqueous solution with additive used in the experiments. The details of calcium napthenate solution in toluene and aqueous solution with additive used in the experiments carried out by the inventor are given in Table 1.

TABLE 1

| Sr. No | Name of the raw materials used | Wt. % | Weight |
|---|---|---|---|
| 1. | Calcium-naphthenate in toluene having an amount of calcium of 2247 ppm in the hydrocarbon layer | 50% | 67 gm |
| 2. | Aqueous solution having additive of present inventions | 50% | 67 gm |

10a. FTIR data-I (a) FTIR spectrum of naturally occurring free naphthenic acid shown in FIG. 1 shows a characteristic peak at about 1700 $cm^{-1}$ due to the presence of carboxylic acid (COOH) group. The acid value of the free acid is about 226 mg/KOH.

Figure 3:
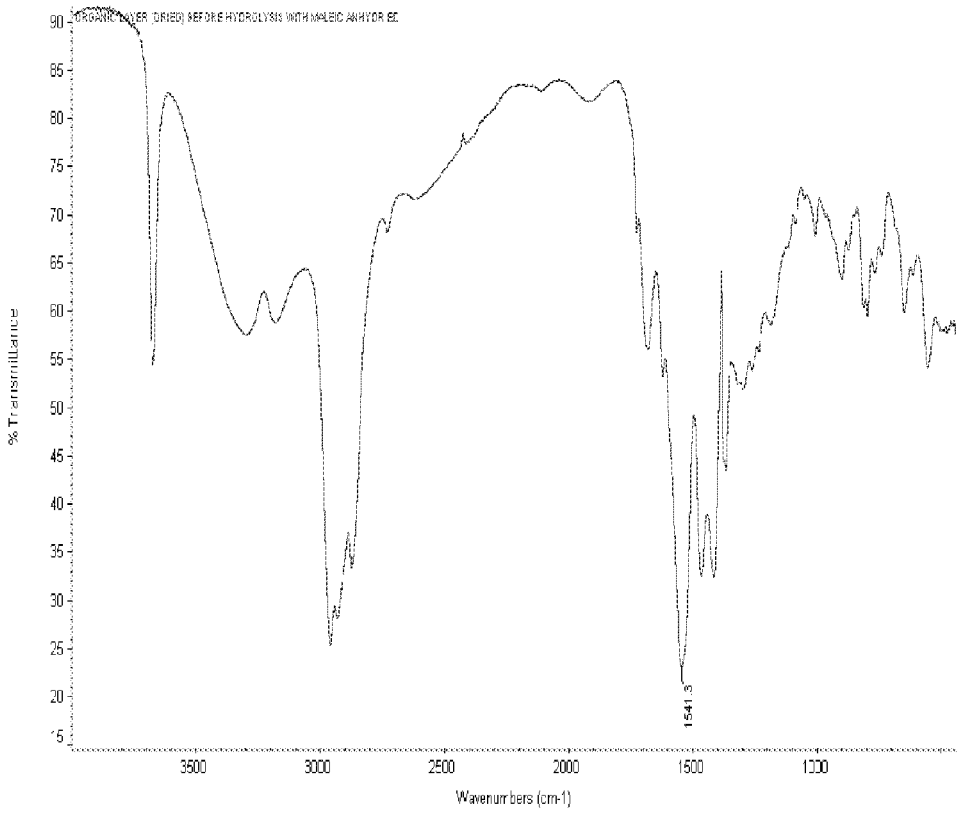
FIG. 3 shows, typical FTIR spectrum of organic layer [Ca-naphthenate in toluene (oven dried)] before reaction.

The FTIR spectrum of calcium napthenate (toluene-free) shows a characteristic peak in the region between 1560 $cm^{-1}$ to 1541 $cm^{-1}$ as shown in FIG. 3.

Figure 2:
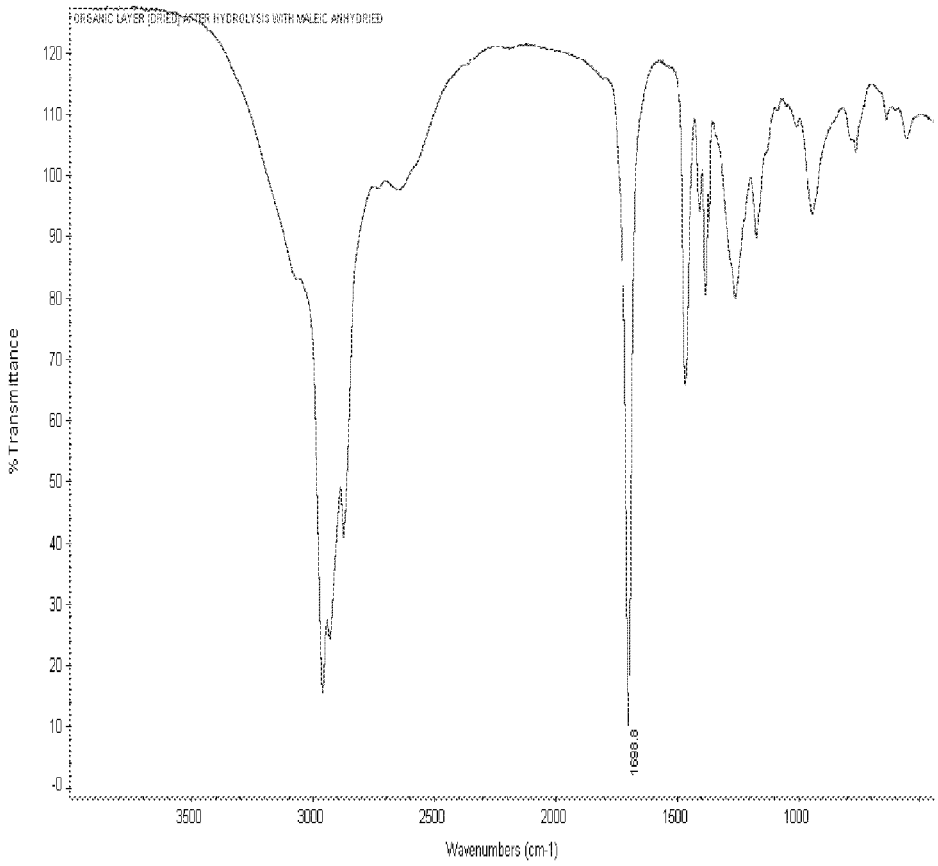
FIG. 2 shows, typical FTIR spectrum of organic layer (oven dried) after reaction.

After completion of conversion-step by reaction of Ca-naphthenate solution in toluene with additives of present invention, it was observed, as shown in FIG. 2, that the toluene free hydrocarboneous layer showed the characteristic peak at about 1698 $cm^{-1}$ indicating the presence of free carboxylic acid group (similar to FIG. 1) wherein FIG. 1 shows FTIR for free naphthenic acid, indicating the presence of free carboxylic acid group such as free naphthenic acid in the hydrocarboneous phase. The complete absence of around the above mentioned region i.e. between 1560 $cm^{-1}$ and 1541 $cm^{-1}$ peak of calcium napthenate in FIG. 2 which is FTIR for organic layer (over dried) after reaction, indicates that the additives are very effective in extracting into the water phase, the Calcium from calcium napthenate which was present in the hydrocarbon feed. The acid value of the dried hydrocarbon layer was also estimated and shown in Tables 10 to 14. It should be noted that the additive which do not remove calcium from calcium naphthenate, does not show any peak at 1698 $cm^{-1}$ and also shows lower acid value.

10b. The FTIR data for all experiments conducted by inventor of present application are provided in FIGS. 1 to 10 and Table numbers 10 to 14, in terms of presence of peak in the above region i.e. about 1545 $cm^{-1}$, indicating presence of calcium Naphthenate. Different intensities of this peak are used to demonstrate extent of conversion of calcium Naphthenate to free Naphthenic Acid. These different intensities and corresponding conversion-extent are given below:

TABLE 2

| | Intensity of Peak | Conversion-extent |
|---|---|---|
| 1. | Strong | Poor conversion |
| 2. | Small | Reasonably good conversion |
| 3. | Faint | Very good conversion |
| 4. | Absent | Best conversion |

11. Ca Content Data:

The effectiveness of the present invention is further proved by measuring the Calcium content in aqueous layer after reaction. The magnitude of calcium removed in the aqueous phase is shown in Table 10 to 14. It can be seen that the efficiency of calcium removal is greater than 80%. This is another evidence of high effectiveness of additives of the present invention in causing complete removal of bound calcium in calcium napthenate which was present in the hydrocarbon feed and extraction of this calcium into the water phase.

12. Calculation of efficiency with respect to calcium removal $$\%\ \text{Efficiency} = \frac{(2247) - \left(\begin{array}{c}\text{calcium content in}\\ \text{aqueous phase in } ppm\end{array}\right)}{2247} \times 100$$

13. Calculation of efficiency with respect to acid value of top organic phase $$\%\ \text{Efficiency} = \frac{(226) - \left(\begin{array}{c}\text{Observed acid value of}\\ \text{top organic phase in mg } KOH/\text{gm}\end{array}\right)}{226} \times 100$$

Example 1

Test Method and Results for Use of Additives

Procedure:

The inventor of present invention has used the following invention additive for calcium-removal.

| | |
|---|---|
| 1. | Diethyl Maleate |
| 2. | Dimethyl Maleate |
| 3. | Dibutyl Maleate |
| 4. | Methyl Formate |
| 5. | Ethyl Formate |
| 6. | Ethyl Acetate |
| 7. | Dimethyl Fumerate |
| 8. | Diethyl Oxalate # |
| 9. | Formic Acid 98% |
| 10. | Di Octyl Maleate |
| 11. | Acrylic Acid |
| 12. | Methyl Acrylate |
| 13. | Methyl Methacrylate |

-continued

| | |
|---|---|
| 14. | Dimethyl Succinate |
| 15. | Diethyl succinate |
| 16. | Maleic Anhydride + Methanol + Water |
| 17. | Maleic Anhydride + Methanol |
| 18. | Maleic Anhydride + Isopropyl alcohol |
| 19. | Maleic Anhydride + Ethanol |
| 20. | Maleic Anhydride + Sodium hydroxide + Water |

Each additive of the present invention, demineralized water and Ca-naphthenate in toluene was charged into a stainless steel autoclave and was reacted at different reaction conditions given below.

TABLE 3

| | Temperature | Time of reaction | Table Nos |
|---|---|---|---|
| 1 | 130° C. | 20 minutes | 10 |
| 2 | 130° C. | 10 minutes | 11 |
| 3 | 130° C. | 1 minute | 12 |
| 4 | 115° C. | 15 minutes | 13 |
| 5 | 115° C. | 1 minute | 14 |

It was cooled to room temperature and the contents of the round bottom flask were poured into a separating funnel. Two separated layers that are top hydrocarboneous layer and bottom aqueous were collected and analyzed as mentioned below. The aqueous layer was analysed for Calcium content using Ion Chromatography. The hydrocarboneous layer was dried to remove toluene and the dried sample was analysed by Fourier Transform Infrared Spectrometer (FTIR) as discussed above, and also analysed for acid value by titrating against standard KOH solution. The results are given in details below and in Tables 10 to 14.

The results of, showing details of effect of storage of methanolic solution of additive of present invention showing drop in acid value and absence of solidification due to storage at extremely low temperature are given in Table 15.

Example 2

Preparation of Methanolic Solution of Additive of Present Invention

In the preparation of methanolic solution of the additive of the present invention, the following steps were used:

(a) 30 gm of methanol was charged to a clean four-necked round bottom flask, equipped with thermometer, stirrer, and inlet for nitrogen, (b) Total of 33 gm of maleic anhydride was added into the above mentioned flask, in six lots;

(c) The mixture was stirred well till a clear solution was obtained, thereby indicating completion of formation of maleic ester;

(d) 37 gms of water was added to the clear solution;

(e) The exotherm of approximately 5° C. to 10° C. was noted;

(f) The mixture was mixed well;

(g) The mixture was analyzed for acid value which was found to be 225 mg KOH/gm; it was observed that the acid value drops on storage of the mixture. For example, the acid value was 196 mg KOH/gm after storing for 17 days and was 145 mg KOH/gm after storing for one year.

(h) The final product obtained after drying, is found to be in liquid form.

Figure 4:
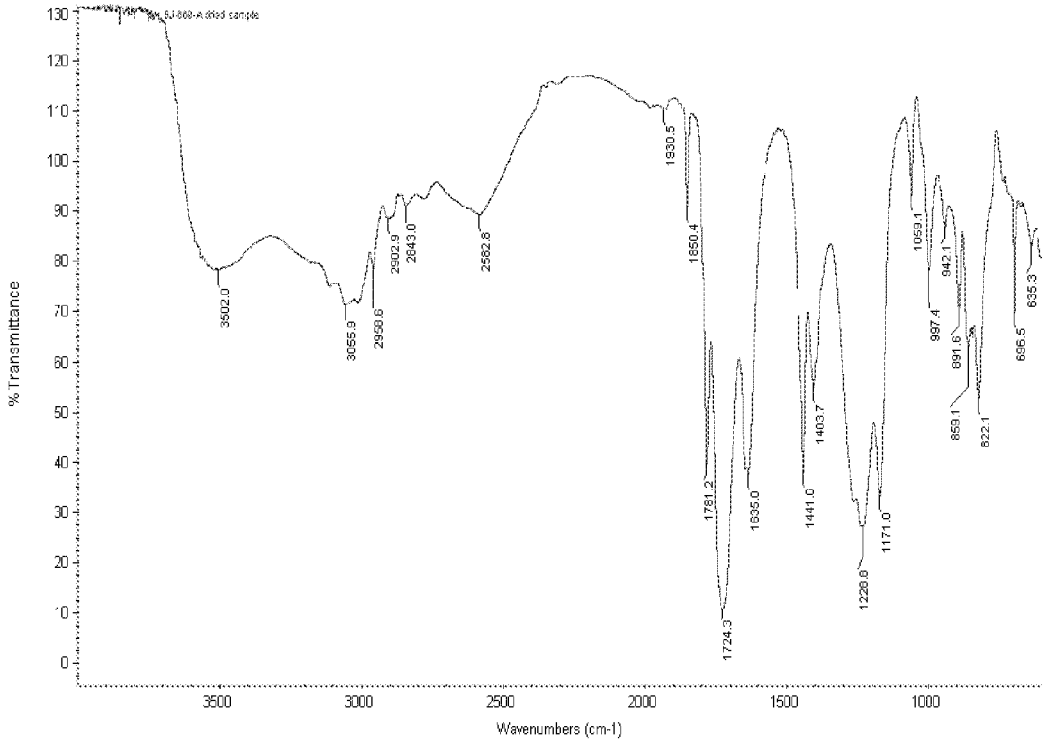
FIG. 4 shows, typical FTIR spectrum of dried maleic anhydride in methanol and water.
Figure 5:
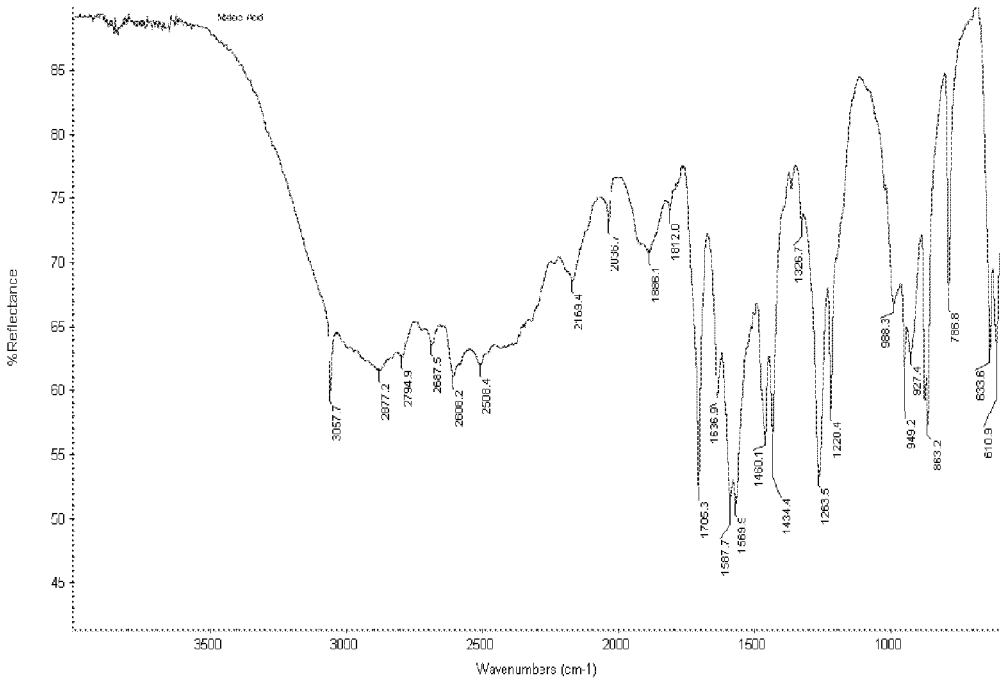
FIG. 5 shows, typical FTIR spectrum of maleic acid.
Figure 6:
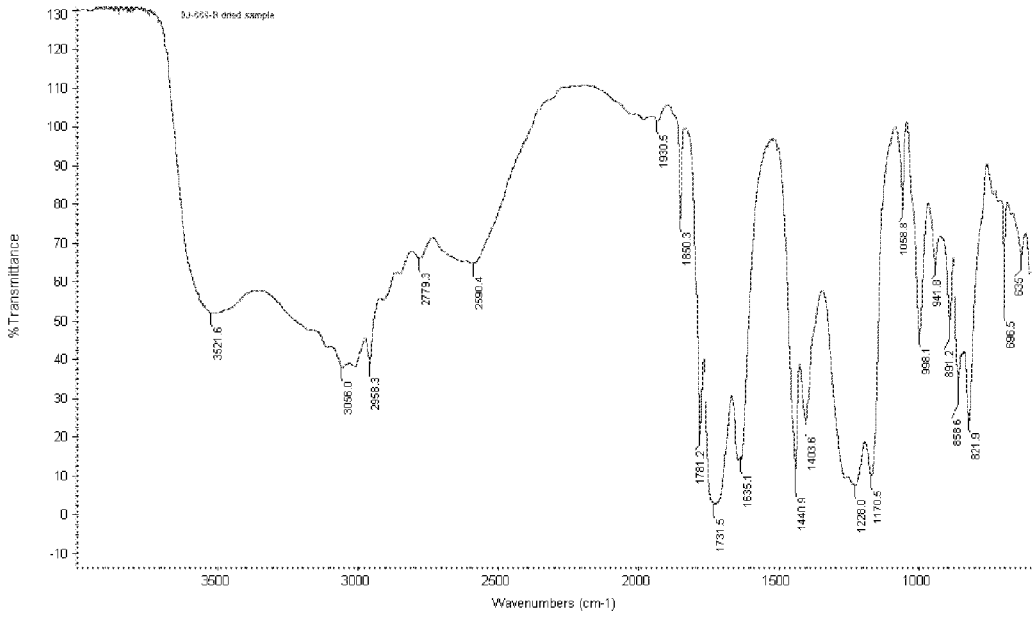
FIG. 6 shows, typical FTIR spectrum of dried maleic anhydride in methanol.
Figure 7:
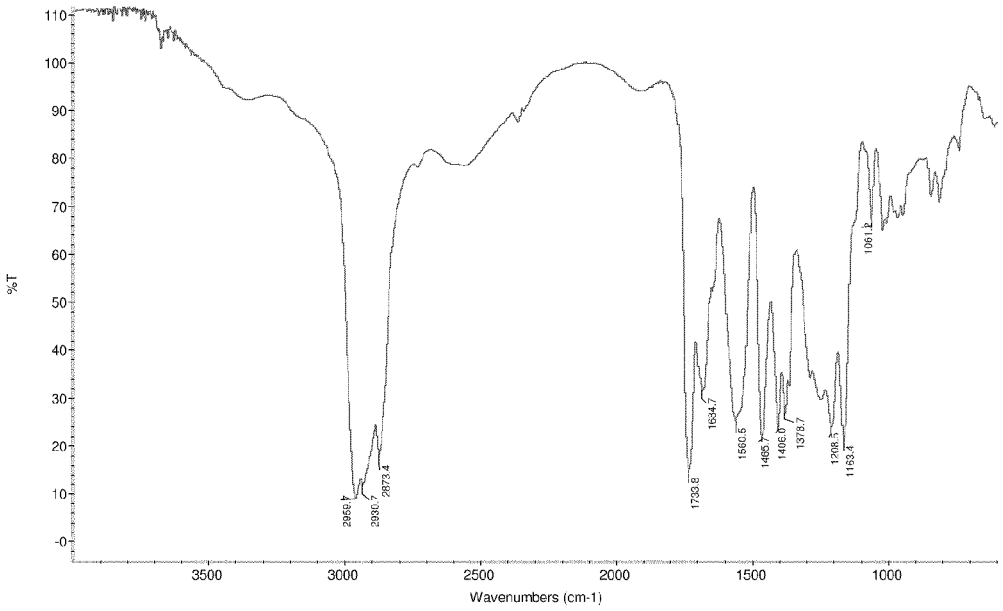
FIG. 7 shows, typical FTIR spectrum of incomplete hydrolysis of calcium Naphthenate.
Figure 8:
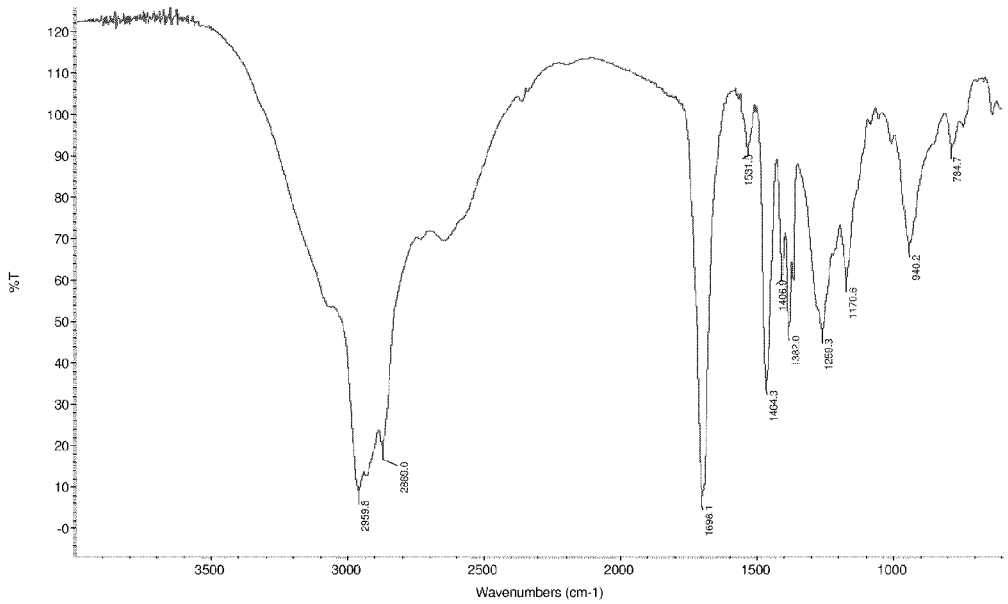
FIG. 8 shows, typical FTIR spectrum of partial hydrolysis of Calcium Naphthenate.
Figure 9:
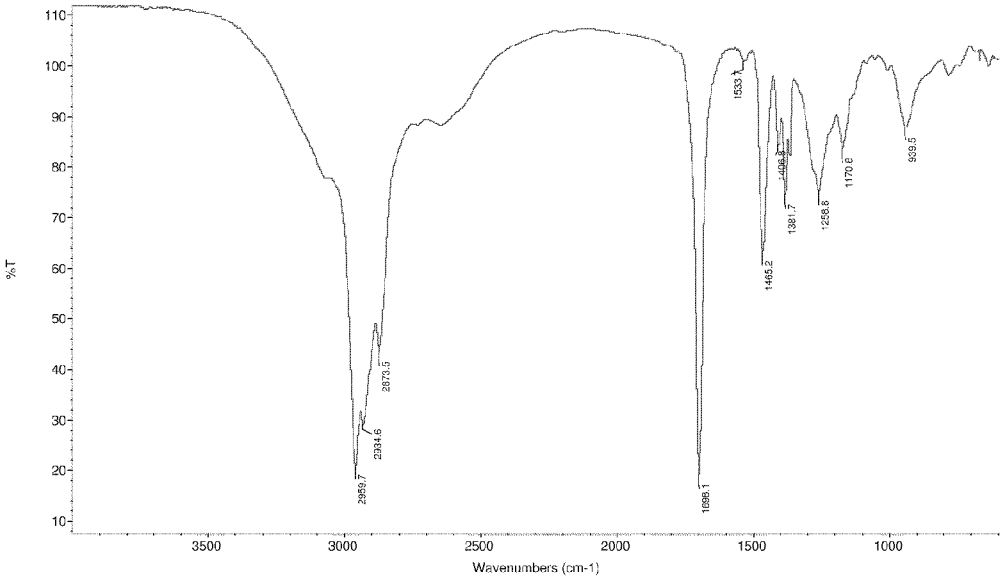
FIG. 9 shows, typical FTIR spectrum of substantial hydrolysis of calcium Naphthenate.
Figure 10:
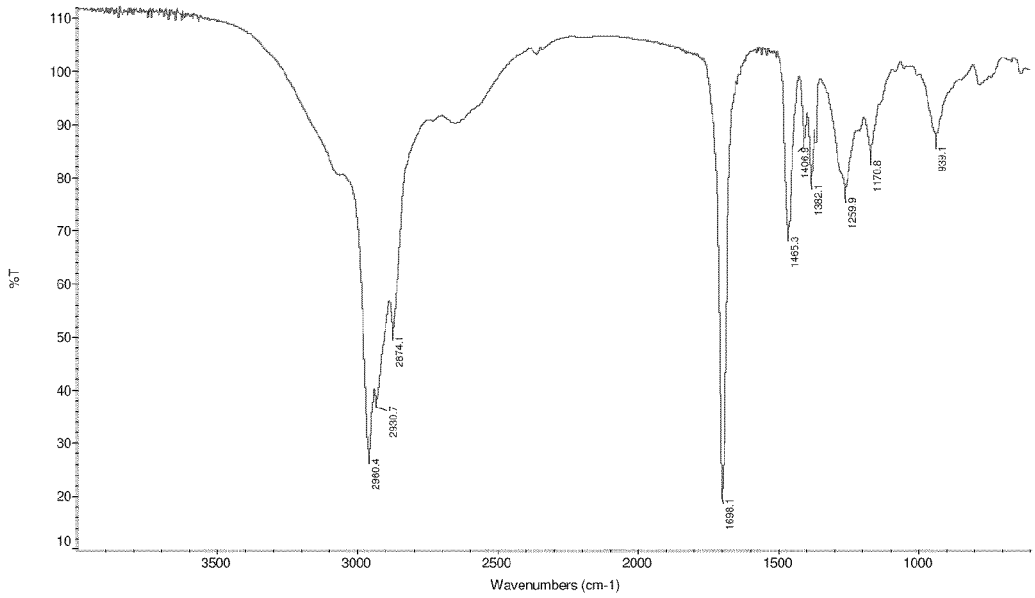
FIG. 10 shows, typical FTIR spectrum of near-complete hydrolysis of calcium Naphthenate.

(i) The formation of ester is confirmed by FTIR given in FIG. 4 which shows presence of a peak at 1725 $cm^{-1}$ in FIG. 4. It can be seen that FIG. 5 which is FTIR spectrum of pure maleic acid is different from the FIG. 4.

The advantage of the present invention can be seen from the fact that before drying action mentioned in step (b) above, the pour point of the solution was below −30° C. and the material did not freeze at −27° C. even after keeping the solution for 20 days at −27° C. temperature. The sample was tested for Calcium removal efficiency after storing for one year. The results are as shown in tables 10 to 14. The acid value of the reaction mass after one year storage was about 145 mg KOH/gm.

The invention-additive of this example was tested for efficiency of calcium removal at various acid values of additive. Typically, efficiencies of calcium removal at given acid values of the additive are in Table 10 to 14.

The typical composition before drying action mentioned in step (b) above, when analysed by Gas Chromatography, was seen to include free maleic acid 3.5%, dimethyl maleate 18.64%, mono methyl maleate 23%, and the rest were methanol and water.

Example 3

Reaction of Maleic anhydride with Methanol

TABLE 4

Mole ratio of Maleic anhydride with Methanol is 1:1.25

| Product Name | Molecular wt | Mole | Wt charged in gms | % wt |
|---|---|---|---|---|
| Maleic anhydride | 98 | 1.0 | 98 | 71.014 |
| Methanol | 32 | 1.25 | 40 | 28.986 |
| | Total # size | | 138 | 100 |

Procedure:

One mole of Maleic anhydride was charged to a clean 250 ml 4 neck RBF equipped with stirrer rod with Teflon blade, Thermometer pocket, water condenser, a dropping funnel and a stopper. The charged compound was heated to 55 deg C. and then 1.25 moles of methanol was added dropwise. During the addition of methanol exotherm was observed. After completion of methanol addition temperature was slowly raised to 80° C. and maintained for 2 hours. At the end of this period, the reaction mass was cooled to room temperature that is about 27° C. The reaction mixture was analysed for Acid Value by titrating against potassium hydroxide. Also a small portion of the sample was dried and analysed by FTIR. The FTIR showed the presence of peak at 1735 $cm^{-1}$ indicating the formation of ester. The GC analysis indicated that reaction mass is a mixture of dimethyl maleate, monomethyl maleate and free maleic anhydride. The acid value of resultant reaction mixtures are given below:

1) TAN (initially after synthesis) about 360.8 mg KOH/gm
2) TAN (after 27 days) about 304.25 mg KOH/gm this sample was used for Ca removal experiments as shown in experiment no. 21 in Table 10 to Experiment no. 10 in table 11.

Example 4

Reaction of Maleic Anhydride with Iso-Propyl Alcohol

TABLE 5

Mole ratio of Maleic anhydride with IPA is 1:2

| Product Name | Molecular wt | Mole | Wt charged in gms | % wt |
|---|---|---|---|---|
| Maleic anhydride | 98.06 | 1.0 | 98 | 44.913 |
| IPA | 60.1 | 2.0 | 120.2 | 55.087 |
| | Total # size | | 218.2 | 100 |

Procedure:

One mole of Maleic anhydride was charged to a clean 500 ml 4 neck RBF equipped with stirrer rod with Teflon blade, Thermometer pocket, water condenser, a dropping funnel and a stopper. The charged compound was heated to 60° C. and then 2 moles isopropyl alcohol (IPA) was added dropwise. During the addition of IPA exotherm was observed. After completion of IPA addition temperature was slowly raised to 100° C. and maintained for 1 hour. At the end of this period the reaction mass was cooled to room temperature that is about 27° C. The reaction mixture was analysed for Acid Value by titrating against potassium hydroxide. Also a small portion of the sample was dried and analysed by FTIR. The FTIR showed the presence of peak at 1735 $cm^{-1}$ indicating the formation of ester. The GC analysis indicated that reaction mass is a mixture of mono esters and diesters of isopropyl alcohol and free maleic anhydride.

The Acid value of the reaction mixture was (initially after synthesis) 256.68 mg KOH/gm. The Acid value of the reaction mixture after 25 days it was 255.3 mg KOH/gm this sample was used for Ca removal experiments as shown in Experiment no. 22 Table 10 to experiment no. 11 in table 11.

Example 5

Reaction of Maleic Anhydride with Methanol

TABLE 6

Mole ratio of Maleic anhydride with Methanol is 1:6.219

| Product Name | Molecular wt | Mole | Wt charged in gms | % wt |
|---|---|---|---|---|
| Maleic anhydride | 98.06 | 1.01 | 99 | 33.00 |
| Methanol | 32 | 6.28 | 201 | 67.00 |
| | Total # size | | 300 | 100 |

Procedure:

6.28 moles of Methanol was charged to a clean 500 ml 4 neck RBF place in water bath equipped with stirrer rod with Teflon blade, Thermometer pocket, water condenser and a stopper, and chilled to 20° C. Then 1.01 mole of Maleic anhydride was added lotwise to RBF. The addition was carried out by maintaining temperature of reaction mass between 18 to 22° C. After the completion of Maleic anhydride addition, stirring was continued for 2 hours, at 20° C. After this, the reaction mass was analysed for TAN and IR Spectroscopy. Reaction mass was found to be clear and colourless. This reaction mass was also analysed by GC and was found to be a mixture of Monomethyl Maleate, dimethyl Maleate and free Maleic anhydride.

The acid value of the composition was 219.72 mg KOH/gm at the time of analysis. Please refer experiment No. 20 in Table 10 and Experiment No. 9 in table 11 and Experiment No. 3 in Table 13 and 14 for Ca removal experiments.

The acid value after 1 year of storage was 40 mg KOH/gm. Please refer Experiment No. 19 in Table 10, Experiment 8 in Table 11 and Experiment No. 5 in Table 12, Experiment 3 in Table 13, and Experiment 2 in Table 14 for Ca removal experiments.

Example 6

Reaction of Maleic Anhydride with Ethanol

TABLE 7

Mole ratio of Maleic anhydride with Ethanol is 1:2

| Product Name | Molecular wt | Mole | Wt charged in gms | % wt |
|---|---|---|---|---|
| Maleic anhydride | 98.06 | 1.00 | 98 | 51.579 |
| Ethanol | 46 | 2.00 | 92 | 48.421 |
| | Total # size | | 190 | 100 |

Procedure:

One mole of Maleic anhydride was charged to a clean 250 ml 4 neck RBF equipped with stirrer rod with Teflon blade, Thermometer pocket, water condenser, a dropping funnel and a stopper, and then 2 moles of Ethanol was added dropwise wherein exotherm was observed. After completion of ethanol addition temperature was slowly raised to 40° C. and maintained for 2 hours. At the end of this period the reaction mass was cooled to room temperature that is 27 degree C. and analysed for TAN and IR Spectroscopy. Reaction mass was observed to be clear and colourless.

The acid value was found to be 314.2 mg KOH/gm after few days of storage.

The Acid value after 15 days it was 261.75 mg KOH/gm. This sample was used for Ca removal. Please refer Experiment No. 23 Table 10 and Experiment No. 12 Table 11.

Example 7

Not an Invention Additive

Reaction of Maleic Anhydride with NaOH (Aqueous)—

TABLE 8

Mole ratio of Maleic anhydride with NaOH (solid) is 1:2

| Product Name | Molecular wt | Mole | Wt charged in gms | % wt |
|---|---|---|---|---|
| Maleic anhydride | 98 | 0.3367 | 33.0 | 8.919 |
| NaOH Flakes | 40 | 0.6750 | 27.0 | 7.297 |
| Water (ultrapure) | 18 | 17.22 | 310 | 83.784 |
| | Total # size | | 370 | |

Procedure:

In a clean 250 ml 4 neck RBF placed in water bath equipped with stirrer rod with Teflon blade, Thermometer pocket, water condenser and a stopper 0.675 mole of NaOH was dissolved in 3.72 moles of water and then maleic anhydride was added lotwise, while controlling exotherm below 50 degree C. After completion addition of maleic anhydride, reaction mass light yellow color with solid. Total reaction mass was transferred into 500 ml beaker and 13.5 mole of water was added to make it clear solution. Please refer Experiment No. 24 Table 10. This proves that salts of Maleic Anhydride are not effective for the removal.

Discussion of Fouling Tendency of Maleic anhydride.

50 gms of 33% solution of maleic anhydride was charged to a clean stainless steel autoclave. The reaction mixture was then heated to 130 deg C. under stirring. The reaction mixture was maintained at this temperature for 1 hour. On cooling to room temperature it was observed that reaction mixture had solidified. Similar experiments were carried out by using invention-additives of present invention, which are: Dimethyl Maleate alone and two compositions given in examples 3 and 4. After cooling it was found that there was no solid formation.

The above experiments clearly prove that maleic anhydride solution in water is extremely unstable. In actual application the ratio of the dosage of calcium to dosage of additive cannot be maintained 1:1 exactly all the time. Sometimes the additive concentration will increase. During such times the unreacted maleic anhydride will tend to foul the system.

Also the maleic anhydride solution in water has very poor low temperature storage property. To maintain it in the liquid forms it will have to be heated generally using steam. The temperature of steam varies between 100° C. to 160° C. It is expected that under continuous exposure of this solution at this temperature will result in solidification of the material. Thus there is a need to improve the additives characteristics.

Discussion about Results Provided in Table No. 10 and 11

It is observed from the results presented in Table 10 and 11 that some of the derivatives of Maleic Anhydride, that is, the ester derivative such as dibutyl malete and dioctyl maleates are not effective in extracting calcium from the calcium naphthenate contained in the hydrocarbon feedstock. It is also observed that, even with high molar ratios of these two esters, observed in Experiment nos. 3 and 4 of table 10, 1:2 and such as 1:3 that is experiment nos. 4 and 5 of table 11 for dibutyl maleate and experiment no. 11 with 1:1 and experiment no. 12 with 1:2 moles of dioctyl maleate, are ineffective in calcium removal. This shows that if anybody claims that each derivative of Maleic Anhydride is effective in calcium removal, then such claim is inappropriate. Please refer to the FTIR spectra shown in the FIG. 7, of the dried hydrocarbon layer which shows strong peak in the region of 1541 $cm^{-1}$ to 1560 $cm^{-1}$ indicating poor extraction of calcium from calcium naphthenate. The FTIR also shows a peak at about 1733 $cm^{-1}$ due to ester group, of unreacted dibutyl maleate.

It is observed from the results presented in experiment no. 24 of Table 10, that sodium salt of Maleic Anhydride, such as disodium maleate is not effective in extracting calcium from the calcium naphthenate contained in the hydrocarbon feedstock. This shows that if anybody claims that each salt of Maleic Anhydride is effective in calcium removal, then such claim is inappropriate.

Referring to Table 10, it is surprisingly found by the present inventor that use of invention-additives such as Dimethyl Maleate and Diethyl Maleate for calcium removal, give very high efficiencies of calcium removal, whereas, even if use of succinct acid as additive for calcium removal performs effectively, its methyl ester and ethyl ester is not effective for calcium removal, even with molar ratio of 1:1 (experiment nos. 16 and 17). Similarly even if use of oxalic acid or diethyl oxalate (experiment no. 9) as additive for calcium removal performs effectively, diethyl oxalate leads to problem of precipitation.

Maleic acid esters can be considered as α,β unsaturated esters, however it is surprisingly found by the present inventor that another α,β unsaturated ester, namely methyl acrylate (experiment 14, Table 10) and methyl-meth-acrylate (experiment 15, Table 10) is not effective in calcium removal.

Discussion of Experimental Results of Use of Composition—Compounds for Calcium Removal:

Additives of Example 2

(i) As per Experiment Nos. 18 of Table 10 and Experiment 7 of Table 11, a reaction mixture of Maleic Anhydride, Methanol and water as prepared in Example 2 leading to composition mixture of Monomethyl maleate and Dimethyl maleate, and Maleic acid are used as an invention-additive for calcium removal. The additive was used after storing for one year and showed an acid value of about 145.4 mg KOH/gm at the time of test. The Table 10 and 11 shows the efficiencies as estimated by acid value are 97.8%, and 90.3% respectively, with extraction-timings of 20 and 10 minutes respectively, with mole ratio of additive to calcium as 1:1 and temperature of 130° C. for each of these 2 experiments. Thus, it is seen that the composition mixture of Monomethyl maleate, Dimethyl maleate and Maleic acid is effective in removing calcium from hydrocarbon feedstock. This is further proved by the FTIR spectra of the organic layer which indicate the absence or presence of only a small peak of calcium napthenate indicating complete or substantial removal of calcium respectively. For mole ratio estimation the amount of maleic anhydride used for synthesis is used. For the present case 1.118 gms of solution was used which was prepared by reaction maleic anhydride methanol and water and had used 33% by weight of maleic anhydride for synthesis, Thus the quantity of maleic anhydride used becomes 0.368 gms. This value is used for the mole ratio calcium with respect to calcium. This is applicable for all the composition of example 2 to example 8.

(ii) As per Experiment Nos. 23 of table 10 and 12, of table 11 a reaction mixture of Maleic Anhydride and Ethanol, leading to composition mixture of Monoethyl maleate, Diethyl maleate and maleic acid, as prepared in Example 6 is used as an invention-additive for calcium removal. The Table 10 and 11 shows the efficiencies as determined by acid value as 95.9% and 91.6% respectively, with extraction-timings of 20 and 10 minutes respectively, with mole ratio of additive to calcium as 1:1 and temperature of 130° C. for each of these two experiments. Thus, it is seen that the composition mixture of Monoethyl maleate, Diethyl maleate and maleic acid is effective in removing calcium from hydrocarbon feedstock. This is further proved by the FTIR spectra of the organic layer which indicate the absence or presence of only a small peak of calcium napthenate indicating complete and substantial removal of calcium respectively.

(iii) As per Experiment Nos. 22 and 11 of table 10 and 11 respectively, a reaction mixture of Maleic Anhydride and Isopropyl Alcohol, leading to composition mixture of Monoisopropyl Maleate and Di-Isopropyl Maleate, and Maleic Anhydride as prepared in example 4 is used as an invention-additive for calcium removal. The Table 10 and 11 shows the efficiencies as estimated by acid value are 92.9%, and 87.9% respectively, with extraction-timings of 20 and 10 minutes respectively, with mole ratio of additive to calcium as 1:1 and temperature of 130° C. for each of these two experiments. Thus, it is seen that the composition mixture of Monoisopropyl Maleate and Di-isopropyl Maleate is effective in removing calcium from hydrocarbon feedstock. The Ca content aqueous phase indicates high efficiency in Ca removal which is 94.8 and 93.7 respectively.

(iv) As per Experiment No. 4, Table 13 a reaction mixture of Maleic Anhydride Methanol and Water leading to composition mixture of Monomethyl Maleate and Dimethyl Maleate and maleic acid i.e. example 2 is used as an invention-additive for calcium removal. The table 13 shows the efficiency as estimated by acid value are 96.1%, with extraction-timing of 15 minutes, with mole ratio of additive to calcium as 1:1 and temperature of 115° C. for this experiment. Thus, it is seen that the composition mixture of Monomethyl Maleate, Dimethyl Maleate, and Maleic acid is effective in removing calcium from hydrocarbon feedstock.

(v) As per Experiment No. 3, a reaction mixture of Maleic Anhydride, Methanol, leading to composition mixture of Monomethyl Maleate and Dimethyl Maleate is used as an invention-additive for calcium removal i.e. example 5. The table 13 shows the efficiency of 86.9%, with extraction-timing of 15 minutes, with mole ratio of additive to calcium as 1:1 and temperature of 115° C. for this experiment. Thus, it is seen that the composition mixture of Monomethyl Maleate and Dimethyl Maleate, is effective in removing calcium from hydrocarbon feedstock.

Discussion about pH of 1000 ppm Solution

The details of experimental results of pH value of 1000 ppm (0.1% solution) of invention-additives and prior-art-additives are given below.

TABLE 9

| | Additives | pH |
|---|---|---|
| 1 | Dimethyl Maleate (Invention-additive) | 5.6 |
| 2 | Diethyl Maleate (Invention-additive) | 5.8 |
| 3 | Maleic Anhydride (prior-art-additive) | 2.2 |
| 4 | Citric acid (prior-art-additive) | 2.9 |

Thus, it can be observed that, even for 1000 ppm concentration of invention additive, pH values are 5.6 and 5.8. Hence this invention-additives can be considered as almost non-corrosive. This will avoid use of any corrosion-inhibitor, thereby leading to huge economic advantages. The prior-art-additives mentioned above, give a pH value, which can be less than 3, which can be considered being very acidic and hence very corrosive.

Discussion about Published Patent Application WO 2008/062433

Referring to the present inventor's published international patent application number WO 2008/062433, it is seen that, when the inventor of the present invention-additives, performed experiments using the prior-art-additives used for calcium-removal, such as succinic acid, malic acid, tartaric acid, citric acid and polymeric form of maleic acid, it was observed that each reaction leads to substantial amount of precipitate, which indicates that it can cause fouling in the desalter unit and also in other units used in processing of hydrocarbon feedstock. It should be noted here that malic acid is a hydroxy derivative of Maleic Anhydride. The succinic acid also is considered as hydrogenated derivative of Maleic Anhydride.

As such there is a need for the hydrocarbon industry, to have a non-precipitating and hence non-fouling additive and also non-corrosive additive to be used for calcium-removal from calcium napthenate contained in the hydrocarbon feedstock.

Discussion about PCT-International Application Publication No. WO 2008/007847

PCT-International Publication Number WO 2008/007847 A1 (International Application No PCT/KR2007/000180, referred to as Document D1 hereinafter, states on page number 7, as following:

"The method of removing the calcium according to the present invention comprises;

1) adding MA or derivatives thereof, which are a hydrophilic compound, to a hydrocarbon source containing calcium, thus preparing a homogeneous mixture;
2) subjecting the MA or derivatives thereof and the calcium napthenate present in the homogenous phase to metal substitution, thus producing calcium dicarboxylate; and
3) desalting the calcium dicarboxylate to thus remove it."

The inventor of D1 has given three examples, illustrating his invention-method, wherein only Maleic acid (MA) is used as additive for calcium removal. The Document D1 does not illustrate any application of any derivatives of Maleic acid, not application of even a single derivative for calcium removal. However the scope, of the invention as claimed by inventor of D1 includes "derivatives of Maleic acid".

As the inventor of D1 has not mentioned any limitation for the derivatives, that is, he has not mentioned that some derivatives are effective in calcium removal and some derivatives are not effective, this clearly implies that, the inventor presumes that, as per the specification and claims of D1, every derivative of MA should be effective in calcium removal.

The inventor of the present application has carried out extensive experimentation in which different esters of Maleic acid (that is derivatives of MA), fumaric acid, and oxalic acid were attempted for calcium removal from hydrocarbon feedstock containing calcium naphthenate. However it was found by the present inventor and as shown in Table No. 10, that Butyl ester of Maleic Acid and Octyl ester of Maleic acid and dioctyl maleate (which can be said to be derivatives of Maleic Acid), are not effective in calcium removal. As such the scope of invention of D1 which includes use of derivatives of Maleic acid in general for effective calcium removal, that is, any derivative of MA of claims allowed to the inventor should not be admissible and the scope should be limited only to use of only Maleic Acid for calcium removal (and not for the derivatives of MA).

However, the inventor of the present application has inventively and surprisingly found after extensive experimentation that two derivatives of Maleic Acid for example, Dimethyl Maleate and Diethyl Maleate, when used in their pure forms work efficiently for calcium removal, said efficiency being higher than 80%, and 53% as shown in Table No. 10.

Similarly, the inventor of the present application has inventively and surprisingly found after extensive experimentation, that the derivatives of Fumaric Acid, for example, Dimethyl Fumerate (when used in its pure forms) work efficiently for calcium removal, said efficiency being higher than 82% as shown in Table No. 10.

The inventor of the present application has also inventively and surprisingly found that, in addition to high efficiency of the Dimethyl maleate and Diethyl maleate in calcium removal, these two compounds also demonstrate effective and desirable properties like non-fouling of equipment due to non-precipitation of their calcium salts, low-temperature storage-ability due to their very low pour points and the non-corrosiveness, due to pH of the 0.1% aqueous solution of invention-compounds being between 5.6 to 6 which is considered to be in the non-corrosive range. This will help to eliminate use of corrosion-inhibitors during the application of invention-compound. Reference should be made to Table No. 9. This has more significance, when one considers that pH of Maleic Anhydride is less than 3, imparting to it the property of extreme corrosiveness).

The inventor of the present application has also inventively and surprisingly found that each of the four compounds, such as, Monomethyl Maleate, Monoethyl Maleate, Monomethyl Fumarate and Monoethyl Fumarate also demonstrate effective calcium removal from hydrocarbon feedstock. In addition these four compounds also demonstrate the properties of non-fouling of equipments due to non-precipitation of their calcium salts and low-temperature-storage-ability due to their very low pour points (Table 15).

The inventor of the present application has also inventively and surprisingly found after extensive experimentation that the following composition-compounds also provide very high effectiveness in calcium removal, as shown in Table 10 to 14.

1) Composition—Compound A
   Maleic Acid plus Methanol, in various ratios of these two compounds
2) Composition—compound B
   Maleic Acid plus Methanol plus Water
3) Composition—Compound C
   Maleic Acid plus various types of Alcohols plus Water.

In addition each of these three composition compounds, that is, A, B, and C demonstrates the properties of non-fouling of equipments due to non-precipitation of their calcium-salts and low-temperature-storage-ability due to their very low pour points (Table 15).

Discussion of Experimental Results of Use of Diesters for Calcium Removal (A) In Table No. 10, details of results of experiments conducted for use of Dimethyl Maleate, Diethyl Maleate and Dibutyl Maleate, for calcium removal, are provided, and are discussed below:

(i) As per Experiment No. 2 of table 10 and 2 of table 11 and experiment 1 of table 12, Dimethyl Maleate used as an invention-additive for calcium removal has shown efficiencies of 92%, 76% and 55%, respectively, with timings of 20, 10 and 1 minutes respectively, with the mole ratio of additive to calcium as 1:1 and temperature of 130° C. for each of these three experiments. Thus it is seen that Dimethyl maleate is effective in removing calcium from hydrocarbon feedstock.

(ii) As per Experiment Nos. 1 of table 10 and 1 of table 11 Diethyl Maleate, used as an additive for calcium removal, has shown efficiencies of 57.5%, 44.1% respectively, with timings of 20, and 10 minutes respectively, with the mole ratio of additive to calcium as 1:1 and temperature of 130° C. for each of these three experiments. Thus it is seen that Diethyl Maleate is effective in removing calcium from hydrocarbon feedstock. However, please refer to the efficiencies of inventive compound example 6 in table 10, experiment no. 23 and experiment 12 of table 11 the efficiencies are 95.9% and 91.6%. Thus, it can be seen that the combination of mono ethyl maleate, diethyl maleate and maleic acid or anhydride give excellent efficiencies.

(iii) As per three Experiments Nos. 3 to 4 of table 10, Dibutyl Maleate, obtained from commercial source with purity thereof being greater than 98% and used as an additive for calcium removal, has shown efficiencies of 30.0%, 26.2% with mole ratios of additive to calcium being 1:1 and 1:2 respectively, with timings of 20 and 1 minutes respectively, at temperature of 130° C. for each of these 2 experiments. This clearly demonstrates that even at higher mole ratios dibutyl maleate is ineffective.

In addition two Experiments Nos. 4 and 5 of table 11, Dibutyl Maleate, used as an additive for calcium removal, has shown efficiencies of 22.7% and 23.9% respectively, with mole ratio of additive to calcium as 1:2 and 1:3 respectively, each of these two experiments conducted for 10 minutes at 130° C. Thus, it is seen that Dibutyl Maleate (a derivative of Maleic acid) is not effective in removing calcium from hydrocarbon feedstock.

The calcium removal efficiency is confirmed by estimating the acid value of dried organic layer. For high efficiency of calcium removal, this acid value should be as close as possible to the acid value of free acid. The calcium removal efficiency is further confirmed by FTIR spectroscopy of top organic layer, and shown in the FIGS. 1 to 10.

In view of the details given in foregoing description of the present invention, it will be apparent to a person skilled in the art that the present invention basically comprises the following items:

Item 1

Method of removing metals from hydrocarbon feedstock using esters of carboxylic acids, comprising the steps of:

a) mixing hydrocarbon stream such as crude oil containing metals and salts thereof, such as calcium and calcium naphthenate, with an effective metal-removing-amount of an aqueous extraction-solution of non-precipitating and non-fouling additive comprising a chemical compound selected from a group consisting of methyl or ethyl or propyl or isopropyl mono- and/or di-esters of any of three carboxylic acids, such as, maleic acid, maleic anhydride, or fumaric acid or an appropriate combination of said esters, or an appropriate combination of any of said esters with any of said three acids, enabling formation of a hydrocarbonous phase and an aqueous phase containing the metal ions;

b) permitting formation of two phases, such as said aqueous phase and said 5 hydrocarboneous phase, wherein said aqueous phase includes ionic water-soluble metal-acid complex, of the calcium salt of said additives;

c) separating or permitting to separate by themselves said two phases in a crude desalter, or by using any of conventional processes of separation, such as countercurrent extraction;

d) removing the separated aqueous phase of step (c), containing said metal-acid complex;

e) processing the separated hydrocarboneous phase of step (c) by downstream hydrocarbon-processing techniques;

wherein, the contact time between said aqueous-extraction-solution and said hydrocarbon stream during the mixing action of step (a) is in the range from two seconds to six hours, preferably from five seconds to two hours;

wherein the temperature in said desalter is in the range from 93° C. to 163° C.; and wherein, the weight-percentage of the dosage of said chemical compound ranges from 0.001 to 5 of weight of said desalter-wash-water.

Item 2

Method of removal of calcium from hydrocarbon feedstock, as described in item 1, wherein the injection of said chemical compound to said desalter-wash-water, is continuous.

Item 3

Method of removal of calcium from hydrocarbon feedstock, as described in item 1, wherein said mixing of step (a) of item 1, is carried out vigorously for enabling said chemical compound to chelate the calcium.

Item 4

Method of removal of calcium from hydrocarbon feedstock, as described in item 1, wherein said chemical compound is used in molar, sub molar or excess-molar concentration with respect to the metals, in said hydrocarbon feedstock, such as said calcium or salt of calcium such as calcium naphthenate.

Item 5

Method of removal of calcium from hydrocarbon feedstock, as described in item 1, wherein said additives is used neat or in solution.

Item 6

Method of removal of calcium from hydrocarbon feedstock, as described in item 1, wherein said additive is added to said aqueous-extraction-solution of item 1, prior to mixing thereof with said hydrocarbon stream.

Item 7

A composition for removing metals from hydrocarbon feedstock using esters of carboxylic acids, comprising an effective metal-removing-amount of an aqueous extraction-solution of non-precipitating and non-fouling additive comprising a chemical compound selected from a group consisting of methyl or ethyl or propyl or isopropyl, mono- and/or di-esters of any of three acids, such as, maleic acid, maleic anhydride, or fumaric acid or an appropriate combination of said esters, an appropriate combination of any of said esters with any of said three acids, enabling formation of a hydrocarbonous phase and an aqueous phase containing the metal ions, while reacting with hydrocarbon stream such as crude oil containing metals and salts thereof, such as calcium and calcium naphthenate.

Item 8

A composition as described in item 7, wherein said composition is used in molar, sub-molar or excess-molar concentration with respect to said metals and salts thereof, in said hydrocarbon feedstock.

Item 9

A composition as described in item 7 where in the acid value of the composition is between 0 mg KOH/gm to 400 mg KOH/gm.

Item 10

A composition as described in item 7, wherein said composition is used neat or in solution and wherein injection of said composition to desalter-wash-water is continuous.

Although the invention has been described with reference to certain preferred embodiments, the invention is not meant to be limited to those preferred embodiments. Alterations to the preferred embodiments described are possible without departing from the spirit of the invention. However, the process and composition described above is intended to be illustrative only, and the novel characteristics of the invention may be incorporated in other forms without departing from the scope of the invention.

The mole ratio of the additives is generally 1:1, mentioned in brackets if more than 1 with respect to Calcium and for composition mixtures of Example 2 to 7 the weight of maleic Anhydride used in the synthesis, is used calculation of mole ratio with respect to calcium.

TABLE NO 10

Reaction Conditions: About 67-68 gm Calcium Naphthenate in toluene having an amount of calcium of 2247 ppm in the hydrocarbon layer + about 67-68 gm DM water + Various Water Soluble Organic Acids (additive compounds) were reacted at 130° C. for 20 minutes.

| Expt. No | Product | Details of source and composition | Wt. of product, gm | Presence of 1541 $cm^{-1}$ in FTIR | Acid Value MgKOH/gm | % Efficiency by AV | Ca in water phase, ppm | % Efficiency By Ca |
|---|---|---|---|---|---|---|---|---|
| 1 | Diethyl Maleate | Merck | 0.648 | Strong peak | 130.01 | 57.5 | 1303 | 42.4 |
| 2 | Dimethyl Maleate | Merck | 0.542 | Faint peak | 214.29 | 94.8 | 2150 | 95.6 |
| 3 | Dibutyl Maleate | SD Fine | 0.859 | Strong peak | 67.75 | 30.0 | 820 | 36.4 |
| 4 | Dibutyl Maleate | SD Fine | 1.718 (1:2) | Strong Peak | 59.14 | 26.2 | 330 | 14.7 |
| 5 | Methyl Formate | Merck | 0.226 | Strong peak | 138.5 | 61.3 | 700 | 31.1 |
| 6 | Ethyl Formate | Merck | 0.278 | Strong Peak | 125.26 | 55.4 | 640 | 28.5 |
| 7 | Ethyl Acetate | Merck | 0.332 | Strong Peak | 76.11 | 33.6 | 216 | 9.6 |
| 8 | Dimethyl Fumerate | Merck | 0.542 | Small Peak | 186.3 | 82.4 | 1790 | 79.7 |
| 9 | Diethyl Oxalate # | SD Fine | 0.550 | Faint Peak | 204.2 | 90.35 | 223 | — |
| 10 | Formic Acid 98% | SD Fine | 0.173 | Strong Peak | 131.1 | 58.0 | 605 | 26.9 |
| 11 | Di Octyl Maleate | Rachana | 1.279 | Strong Peak | 41 | 18.1 | 340 | 15.1 |
| 12 | Di Octyl Maleate | Rachana | 2.558 (1:2) | Strong peak | 33.8 | 15.0 | 325 | 14.5 |
| 13 | Acrylic Acid | Commercial | 0.27 | Strong Peak | 157.3 | 69.6 | 1516 | 67.5 |
| 14 | Methyl Acrylate | Spectochrome | 0.33 | Strong Peak | 103.59 | 45.8 | 1091 | 48.6 |
| 15 | Methyl Methacrylate | Commercial | 0.34 | Strong Peak | 61.3 | 24.1 | 521 | 23.2 |
| 16 | Dimethyl Succinate | Lancester | 0.550 | Strong Peak | 156.9 | 69.4 | 1573 | 70.0 |
| 17 | Diethyl Succinate | Lancester | 0.655 | Strong Peak | 87.04 | 38.5 | 786 | 34.9 |
| 18 | Example 2* | MA + MeOH + Water (33/30/37) | 1.118 | absent | 221.0 | 97.8 | 2205 | 98.1 |
| 19 | Example 5* | MA + MeOH (33/67) | 1.118 | absent | 217.11 | 96.1 | 2218 | 98.7 |
| 20 | Example 5 | MA + MeOH (33/67) | 1.118 | absent | 221.0 | 97.7 | 2202 | 98.0 |
| 21 | Example 3 | MA + MeOH (1:1.25 mole) | 0.519 | Faint peak | 214.42 | 94.9 | 2158 | 96.0 |
| 22 | Example 4 | MA + IPA (1:2 mole) | 0.821 | Small peak | 210.0 | 92.9 | 2130 | 94.8 |
| 23 | Example 6 | MA + Ethanol (1:2 mole) | 0.715 | absent | 216.66 | 95.9 | 2237 | 99.6 |
| 24 | Example 7 | MA + NaOH + water 8.919/7.297/83.784 | 4.22 | Strong | 63.28 | 28.0 | 475 | 21.1 |

Diethyl Oxalate #: Heavy ppt at the time of Test. Due to the pptation of Calcium salt efficiency not calculated.

Example 2* (Used after 1 year storage)) MA = Maleic Anhydride, MeOH = methanol, IPA = Isopropyl Alcohol, Example 5** (used after 1 year storage)

TABLE 11

Reaction Conditions: About 67-68 gm Calcium Naphthenate in toluene having an amount of calcium of 2247 ppm in the hydrocarbon layer + about 67-68 gm DM water + Various Water Soluble Organic Acids (additive compounds) were reacted at 130° C. for 10 minutes.

| Expt. No | Product | Details of source and composition | Wt. of product, gm | Presence of 1557 $cm^{-1}$ in FTIR | Acid Value MgKOH/gm | % Efficiency by AV | Ca in water phase, ppm | % Efficiency |
|---|---|---|---|---|---|---|---|---|
| 1 | Diethyl Maleate | Merck | 0.648 | Strong peak | 99.58 | 44.1 | 1470 | 65.4 |
| 2 | Dimethyl Maleate | Merck | 0.542 | Small peak | 195.0 | 86.2 | 2103 | 93.6 |
| 3 | Dibutyl Maleate | SD Fine | 0.859 | Strong peak | 68.37 | 30.3 | 650 | 28.9 |
| 4 | Dibutyl Maleate | SD Fine | 1.718 (1:2) | Strong Peak | 51.4 | 22.7 | 400 | 17.8 |
| 5 | Dibutyl Maleate | SD Fine | 2.577 (1:3) | Strong peak | 54.0 | 23.9 | 405 | 18.0 |
| 6 | Dimethyl Fumerate | Merck | 0.542 | Small Peak | 175.68 | 77.7 | 1710 | 76.1 |
| 7 | Example 2* | MA + MeOH + Water (33/30/37) | 1.118 | Small Peak | 204.0 | 90.3 | 2130 | 94.8 |
| 8 | Example 5** | MA + MeOH (33/67) | 1.118 | Small peak | 202.48 | 89.6 | 2148 | 95.6 |
| 9 | Example 5 | MA + MeOH (33/67) | 1.118 | Faint peak | 210.17 | 93.0 | 2185 | 97.2 |
| 10 | Example 3 | MA + MeOH (1:1.25 mole) | 0.519 | Faint peak | 209.89 | 92.9 | 2210 | 98.4 |
| 11 | Example 4 | MA + IPA (1:2 mole) | 0.821 | Small peak | 198.76 | 87.9 | 2105 | 93.7 |
| 12 | Example 6 | MA + Ethanol (1:2 mole) | 0.715 | Small peak | 207.0 | 91.6 | 2130 | 94.8 |

Example 2* (Used after 1 year storage) MA = Maleic Anhydride, MeOH = methanol, IPA = Isopropyl Alcohol,
Example 5** (used after 1 year storage)

TABLE 12

Reaction Conditions: About 67-68 gm Calcium Naphthenate in toluene having an amount of calcium of 2247 ppm in the hydrocarbon layer + about 67-68 gm DM water + Various Water Soluble Organic Acids (additive compounds) were reacted at 130° C. for 1 minute.

| Expt No | Product | Details of source and composition | Wt. of product, gm | Presence of 1557 $cm^{-1}$ in FTIR | Acid Value MgKOH/gm | % Efficiency by AV | Ca in water phase, ppm | % Efficiency |
|---|---|---|---|---|---|---|---|---|
| 1 | Dimethyl Maleate | Merck | 0.542 | Strong peak | 127.8 | 56.5 | 1350 | 60.0 |
| 2 | Dibutyl Maleate | SD Fine | 0.859 | Strong peak | 49.1 | 21.7 | 335 | 14.9 |
| 3 | Example 2* | MA + MeOH + Water (33/30/37) | 1.118 | Small Peak | 195.01 | 86.3 | 1900 | 84.5 |
| 4 | Dimethyl Fumerate | Merck | 0.542 | Strong Peak | 128.9 | 57 | 725 | 32.3 |
| 5 | Example 5** | MA + MeOH (33/67) | 1.118 | Strong peak | 145.6 | 64.4 | 1585 | 70.5 |

Example 2* (Used after 1 year storage) MA = Maleic Anhydride, MeOH = methanol, IPA = Isopropyl Alcohol

TABLE 13

Reaction Conditions: About 67-68 gm Calcium Naphthenate in toluene having an amount of calcium of 2247 ppm in the hydrocarbon layer + about 67-68 gm DM water + Various Water Soluble Organic Acids (additive compounds) were reacted at 115° C. for 15 minutes.

| Expt. No | Product | Details of source and composition | Wt. of product, gm | Presence of 1557 $cm^{-1}$ in FTIR | Acid Value MgKOH/gm | % Efficiency by AV | Ca in water phase, ppm | % Efficiency |
|---|---|---|---|---|---|---|---|---|
| 1 | Example 2* | MA + MeOH + Water (33/30/37) | 1.118 | Small Peak | 188.7 | 83.5 | 1990 | 88.6 |
| 2 | Example 5** | MA + MeOH (33/67) | 1.118 | Small Peak | 173.0 | 76.5 | 1730 | 77.0 |
| 3 | Example 5 | MA + MeOH (33/67) | 1.118 | Small Peak | 196.46 | 86.9 | 1980 | 88.1 |
| 4 | Example 2 | MA + MEOH + Water (33/30/37) | 1.118 | absent | 222 | 96 | 2147 | 95.5 |

TABLE 14

Reaction Conditions: About 67-68 gm Calcium Naphthenate in toluene having an amount of calcium of 2247 ppm in the hydrocarbon layer + about 67-68 gm DM water + Various Water Soluble Organic Acids (additive compounds) were reacted at 115° C. for 1 minute.

| Expt No | Product | Details of source and composition | Wt. of product, gm | Presence of 1557 $cm^{-1}$ in FTIR | Acid Value MgKOH/gm | % Efficiency by AV | Ca in water phase, ppm | % Efficiency |
|---|---|---|---|---|---|---|---|---|
| 1 | Example 2* | MA + MeOH + Water (33/30/37) | 1.118 | Strong Peak | 150.68 | 66.7 | 1550 | 69.0 |
| 2 | Example 5** | MA + MeOH (33/67) | 1.118 | Strong Peak | 106.2 | 47.0 | 1379 | 61.4 |
| 3 | Example 5 | MA + MeOH (33/67) | 1.118 | Strong Peak | 148.0 | 65.5 | 1572 | 70.0 |

Example 2* (Used after 1 year storage) MA = Maleic Anhydride, MeOH = methanol, IPA = Isopropyl Alcohol,
Example 5** (used after 1 year storage)

TABLE 15

Effect of storage of the methanolic solution of additive −27° C.

| Expt No. | Product | Product Details | Pour point (° C.) | Stability at −27° C. After 6 months |
|---|---|---|---|---|
| 1 | Example 2 | 33% maleic anhydride + 30% MeOH + 37% water | <−35 | Clear solution |
| 2 | Example 3 | 33% maleic anhydride + 67% MeOH | <−35 | Clear solution |
| 3 | Prior art additive | 33% maleic anhydride + 67% water | −6 | Complete solidification within 5 hrs |
| 4 | Prior art additive | 33% oxalic acid + 67% MeOH | — | 1-2% solidification 2 days |

The invention claimed is:

1. A method of removing metals from hydrocarbon feedstock using esters of carboxylic acids or combinations thereof, comprising the steps of:

a) mixing a hydrocarbon stream containing metals and salts thereof, wherein the metal includes calcium and its salt is calcium naphthenate, with an effective metal removing amount of an aqueous extraction solution of non-precipitating and non-fouling additive comprising a chemical compound selected from a group consisting of:

i) methyl or ethyl or propyl or isopropyl mono-esters of any one of the carboxylic acids selected from the group consisting of maleic acid, maleic anhydride, and fumaric acid;

ii) methyl or ethyl or propyl or isopropyl di-esters of any one of the carboxylic acids selected from the group consisting of maleic acid, maleic anhydride, and fumaric acid;

iii) an appropriate combination of said esters; and iv) an appropriate combination of any of said esters with any of said carboxylic acids;

b) forming an aqueous phase and a hydrocarboneous phase, wherein said aqueous phase includes an ionic water soluble metal acid complex of the calcium salt of said additive;

c) separating or permitting to separate by themselves said two phases in a crude desalter, or by using a conventional separation process;

d) removing the separated aqueous phase of step c), containing said metal acid complex;

e) processing the separated hydrocarboneous phase of step c) by a downstream hydrocarbon processing technique;

wherein the contact time between said aqueous extraction solution and said hydrocarbon stream during the mixing action of step a) is in the range from two seconds to six hours;

wherein the temperature in said desalter is in the range from 93° C. to 163° C.; and wherein, the weight percentage of the dosage of said chemical compound ranges from 0.001 to 5 of weight of said desalter wash water.

2. The method of removal of calcium from hydrocarbon feedstock, as claimed in claim 1, wherein the injection of said chemical compound to said desalter wash water, is continuous.

3. The method of removal of calcium from hydrocarbon feedstock, as claimed in claim 1, wherein said mixing of step a) of claim 1 is carried out vigorously to form said chemical compound to chelate the calcium.

4. The method of removal of calcium from hydrocarbon feedstock, as claimed in claim 1, wherein said chemical compound is used in molar, sub molar or excess molar concentration with respect to said metal or said salt thereof in said hydrocarbon feedstock.

5. The method of removal of calcium from hydrocarbon feedstock, as claimed in claim 1, wherein said additive is used neat or in solution.

6. The method of removal of calcium from hydrocarbon feedstock, as claimed in claim 1, wherein said additive is added to said aqueous extraction solution, prior to mixing with said hydrocarbon stream.

7. The method of removal of calcium from hydrocarbon feedstock, as claimed in claim 1, wherein said hydrocarbon stream is crude oil.

8. The method of removal of calcium from hydrocarbon feedstock, as claimed in claim 1, wherein said conventional process of separation is countercurrent extraction.

9. The method of removal of calcium from hydrocarbon feedstock as claimed in claim 1, wherein said contact time between said aqueous extraction solution and said hydrocarbon stream during the mixing action of step a) is in the range from five seconds to two hours.

10. A method comprising using a composition for removing metals from hydrocarbon feedstock wherein the composition comprises esters of carboxylic acids or combinations thereof in an effective metal-removing-amount of a neat form or an aqueous extraction-solution form or hydrocarbon solution form of non-precipitating and non-fouling additive comprising a chemical compound selected from a group consisting of:

i) methyl or ethyl or propyl or isopropyl mono ester of any one of the carboxylic acids selected from the group consisting of maleic acid, maleic anhydride, and fumaric acid;

ii) methyl or ethyl or propyl or isopropyl di-ester of any one of the carboxylic acids selected from the group consisting of maleic acid, maleic anhydride and fumaric acid;

iii) an appropriate combination of said esters; and iv) an appropriate combination of any of said esters with any of said carboxylic acids;

to form a hydrocarboneous phase and an aqueous phase containing metal ions while reacting with hydrocarbon stream containing metals and salts thereof, wherein said metal includes calcium and said salt is calcium naphthenate.

11. The method as claimed in claim 10, wherein said composition is used in one of the concentrations selected from molar concentration, sub-molar concentration, and excess-molar concentration with respect to said metal and salt thereof, in said hydrocarbon feedstock.

12. The method as claimed in claim 10, wherein said composition is used in aqueous extraction-solution form and wherein mixing of said composition to desalter-wash-water is continuous.

13. The method as claimed in claim 10, wherein the acid value of the composition is between 0 mg KOH/gm to 400 mg KOH/gm.

14. The method as claimed in claim 10, wherein said aqueous phase contains said metal ions as ionic water soluble metal acid complex of the calcium salt of said additive.

15. The method as claimed in claim 10, wherein said method further comprises the steps of:

a) separating or permitting to separate by themselves said two phases in a crude desalter, or by using a conventional separation process;

b) removing the separated aqueous phase of step a), containing said metal acid complex; and c) processing the separated hydrocarboneous phase of step a) by a downstream hydrocarbon processing technique.

16. The method as claimed in claim 15, wherein temperature in the desalter is in the range from 93° C. to 163° C.

17. The method as claimed in claim 10, wherein said aqueous extraction solution and said hydrocarbon stream are mixed for a time varying from two seconds to six hours.

18. The method as claimed in claim 10, wherein weight percentage of dosage of said chemical compound ranges from 0.001 to 5 of weight of desalter wash water.

* * * * *